US005114192A

United States Patent [19]

Toledo et al.

[11] Patent Number: 5,114,192

[45] Date of Patent: May 19, 1992

[54] LATCHING SYSTEM

[75] Inventors: George F. Toledo, Fall Brook; James A. O'Brien, Burbank, both of Calif.

[73] Assignee: Thomas Industries, Inc., Louisville, Ky.

[21] Appl. No.: 664,797

[22] Filed: Mar. 5, 1991

[51] Int. Cl.[5] ..... E06B 7/20; E05C 3/02

[52] U.S. Cl. ..... 292/21

[58] Field of Search ..... 292/92, 21, 216, 280, 292/336, 210

[56] References Cited

U.S. PATENT DOCUMENTS

| | | | |
|---|---|---|---|
| 1,721,489 | 7/1929 | Prinzler | 292/21 |
| 3,083,560 | 4/1963 | Scott | 292/21 X |
| 3,123,387 | 3/1964 | Jackson et al. | 292/21 |
| 3,214,947 | 11/1965 | Wikkerink | 292/92 X |
| 3,334,500 | 8/1967 | Bejarano | 70/92 |
| 3,583,740 | 6/1971 | Armstrong | 292/21 |
| 3,776,582 | 12/1973 | Balducci | 292/92 |
| 3,788,687 | 1/1974 | Zawadzki | 292/92 |
| 3,940,886 | 3/1976 | Ellingson, Jr. | 49/319 |
| 3,993,335 | 11/1976 | Schmidt | 292/21 |
| 4,204,369 | 5/1980 | Hubbard | 49/319 |
| 4,283,882 | 8/1981 | Hubbard et al. | 49/141 |
| 4,545,606 | 10/1985 | Vodra | 292/92 |
| 4,819,976 | 4/1989 | Bert | 292/48 |
| 4,836,587 | 6/1989 | Choi | 292/216 |
| 4,839,988 | 6/1989 | Betts et al. | 49/141 |

*Primary Examiner*—Richard E. Moore

*Attorney, Agent, or Firm*—Hill, Van Santen, Steadman & Simpson

[57] ABSTRACT

A latch assembly for use with a panic exit device, particularly a top latch having a U-shape which engages a stem portion of a T-shaped receiving lug mounted overhead to a top member of the door frame. The U-shaped top latch is pivotably mounted to the active stile of the door. The latch assembly causes the U-shaped latch to pivot upward to capture the stationary T-shaped receiving lug, or pivot downwardly to disengage from the T-shaped receiving lug. The latch member is in sliding and abutting engagement with a latch cam which pivots in one direction to retain the latch member in an upward orientation to capture the T-shaped receiving lug, and pivots in an opposite direction to allow the latch member to pivot downwardly upon opening pressure on the door and actuation of the panic exit device, to release the latch member from the receiving lug. The latch cam is activated by movement of a panic bar of a panic exit device mounted onto the door, and the latch cam, once moved to disengage the latch member from the receiving lug, holds the latch member in a condition for automatic re-engagement with the receiving lug once the door re-closes.

21 Claims, 3 Drawing Sheets

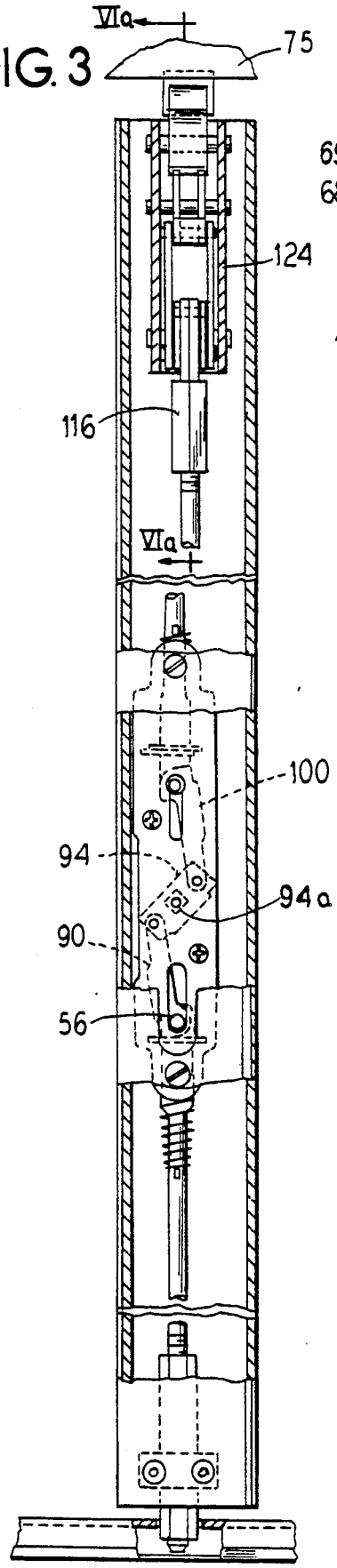
FIG. 3
FIG. 4
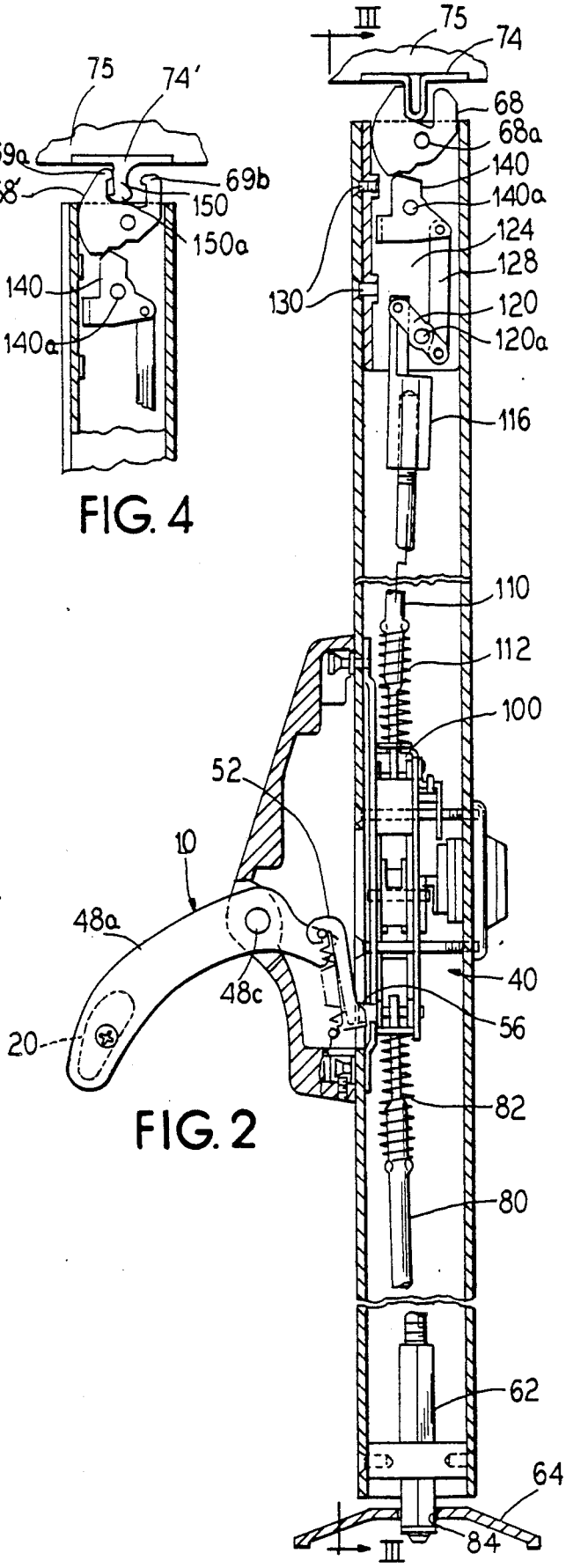
FIG. 2

LATCHING SYSTEM

BACKGROUND OF THE INVENTION

This invention relates to panic exit devices having one or more latches carried by the door which engage receiving portions mounted on door frameworks surrounding the door. In particular, the invention relates to panic exit devices having one or more vertically operating latches at the top and/or bottom of the door. Examples of such devices wherein the bolts may be retracted by a panic exit device are described in U.S. Pat. No. 3,993,335 to Schmidt, U.S. Pat. No. 3,940,886 to Ellingson, Jr., and U.S. Pat. No. 4,839,988 to Betts et.al.

There are numerous types and styles of mechanisms used for operating the popular commercial and industrial door latches wherein the latches such as bolts extend vertically from the top and bottom of the door and engage the top and bottom door frame members. These devices can include a panic bar release mechanism on one side of the door for rapid release of the bolts by depressing the panic bar to open the door.

Another desirable feature of a latch system is a provision wherein after the latch is disengaged by actuating the panic exit device, the latch is retained in a condition for easy re-engagement when the door closes. In an extending bolt-type latch a mechanism for retaining the retracted bolt in a retracted position after the door is opened and continuously while the door is opened, can serve this function. This feature prevents the need to continue pressure on the panic bar or the key in order to prevent the bolt from interfering with objects such as the ground or the door frame while the door is being opened and returned to the closed position. Thus, the bolt retaining mechanism is designed to hold the bolt in a retained condition and to trigger and release the bolt when the door again reaches the closed position. U.S. Pat. Nos. 4,283,882, 3,993,335 and U.S. Pat. No. 3,334,500 show such bolt or latch mechanisms.

SUMMARY OF THE INVENTION

The invention disclosed herein provides an improved panic exit device latching mechanism. The invention provides a latch which, rather than vertically extending from the door to engage the door frame, rotatably engages a receiving member mounted on the door frame. This latching mechanism, upon mechanical instructions from the actuation of the panic exit device, or other device such as a key lock, is rotated into a disengaging position to allow the door to be opened.

The invention also provides for a smooth and foolproof re-engagement of the latching mechanism to the door frame, that is to a stationary receiving lug mounted to the door frame, wherein the latch pivots on contact with the lug during door closure to the door frame, to capture the receiving lug in an automatic fashion. The invention requires no aperture in the door frame for receiving a bolt therein, hence alignment problems between the bolt and such aperture are avoided. The receiving lug can be positionally aligned more easily than can an actual aperture cavity cut into a door frame.

The pivoting engagement of the latch allows for an over closure of the door. The U-shape recess in the latch has sufficient pivot play that the latch can capture the lug and continue to rotate a small amount after complete capture of the lug into the U-shape recess.

This feature allows over travel of the latch during closure.

The latch and lug arrangement eliminates the need for a spring loaded vertically driven latch bolt arrangement which can be susceptible to tampering and retraction by use of a credit card or screwdriver.

The latch mechanism of the present invention provides a durable, long-lasting, simple, easily manufactured, and cost efficient arrangement. The present invention provides a latching assembly which can be used with a conventional panic exit device and appertaining mechanical components.

BRIEF DESCRIPTION O THE DRAWINGS

FIG. 2 is a sectional view of the panic exit device taken generally along line II—II of FIG. 1, and including a complete active door stile from top door frame to bottom door frame;

FIG. 3 is a sectional view taken generally along III—III of FIG. 2;

FIG. 4 is a partial sectional view of an alternate embodiment f a door latch assembly;

DETAILED DESCRIPTION OF THE PREFERRED EMBODIMENTS

Figure 1:
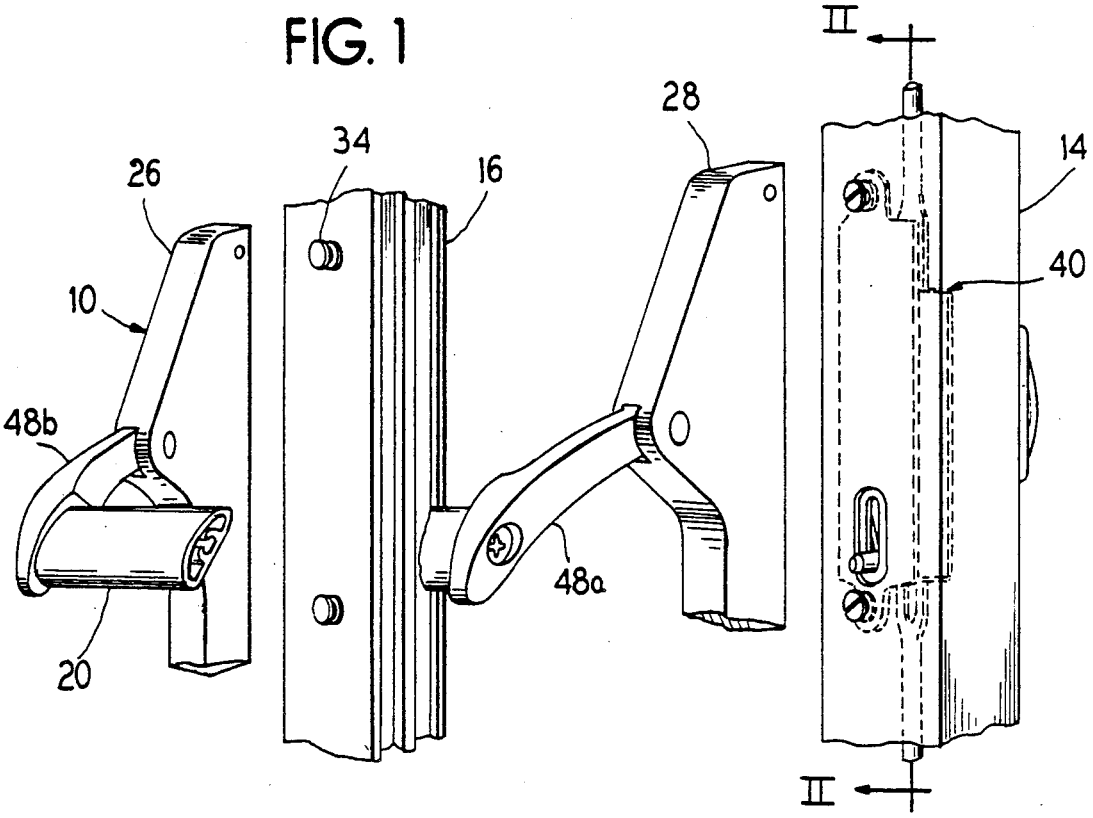
FIG. 1 is a partial perspective view of a panic exit device and a left and right door stile for mounting the panic exit device thereon.

FIG. 1 shows a panic exit device generally at 10 to be mounted to two upstanding and parallel door stiles, an active door stile 14 and an inactive door stile 16. The terms active and inactive correspond respectively to the swinging and hinged door styles respectively. The panic exit device 10 comprises a push bar 20 mounted pivotably at two frame members 26, 28 which mount to the door stiles 14, 16 by use of a plurality of shoulder screws 34. Inside the active door stile 14 resides latch retraction mechanicals 40 which communicate the pivoting movement of the push bar 20 to oppositely arranged latches (described hereinafter). A more complete description of the operation of the panic exit device and mechanicals is disclosed in U.S. Pat. No. 3,993,335 to Schmidt and U.S. Pat. No. 4,839,988 to Betts et.al. which are herein incorporated by reference.

A door panel (not shown) would normally be arranged between, and connected to the two door stiles 14, 16.

FIG. 2 and FIG. 3 show the latch mechanicals in more detail. The panic exit device 10 has oppositely arranged side levers 48*a*, 48*b* which are mounted pivotally at axial pins 48c to the frame members 26, 28. The side lever 48a communicates with a lifting lever 52 which lifts an actuating pin 56 to retract; a bottom latch bolt 62 from engagement with a bottom door frame 64; and a top latch 68 from engagement with a receiving lug 74 mounted in a top frame member 75 of the door frame.

Particularly, when the push bar 20 is depressed, the side levers 48a, 48b pivot about the axial pins 48c and lift the lifting lever 52 upward. The lifting lever 52 lifts the actuating pin 56 upward. The actuating pin 56 lifts a first rod 80 against a bias of a first spring 82 to lift the bottom latch bolt 62 from a cavity 84 formed in the bottom frame member 64. The bottom latch bolt 62 is attached at a bottom end of the first rod 80.

The actuating pin 56 is also connected to a first link 90 which is pinned to one end of a first reversing link 94 which can pivot about a first pivot pin 94a which is rotatably mounted with respect to the door stile 14. The term "pinned" and "pivot pin" connote a pivotable connection; use of a bolt, rivet, axle or other such pivotable connection is considered herein to be equivalent to a pinned connection. The first reversing link 94 is pinned at an opposite end to a second link 100 which connects the first reversing link 94 to a second rod 110. Lifting of the first link 90 causes the first reversing link 94 to pivot about the first pivot pin 94a, causing the second link 100 to proceed downwardly. The second link 100 therefore pulls the second rod 110 downward with respect to the door stile 14 against the bias of a second spring 112. The second rod 110 extends upwardly to a connector 116 which is pinned at its upward end to one end of a second reversing link 120. The second reversing link 120 is pinned to a latch frame 124 at a second pivot pin 120a. A third link 128 is pinned to the second reversing link 120 at an end opposite to the connector 116. The latch frame 124 is attached to the active door stile 14 such as by screws 130. Thus, downward retraction of the second rod 110 retracts downwardly the connector 116, retraction of the connector 116 pivots the second reversing link 120 which causes the third link 128 to move upwardly. At an end of the third link 128 opposite to the reversing link 120, the third link 128 connects to a latch cam 140 at an attachment pin 128a . The latch cam 140 is pinned to the latch frame 124 at a third pivot pin 140a. The latch cam 140 is in abutting engagement with the top latch 68 which is also pinned to the latch frame 124 at a fourth pivot pin 68a . As will be described more clearly with respect to FIGS. 6AD and FIGS. 7A–7C the lifting of the third link 128 causes rotation of the latch cam 140 which slides against the top latch 68. The top latch 68 is caused to pivot about the fourth pivot pin a by abutting force from a stem 150 of the receiving lug 74. FIG. 4 shows an alternate embodiment of the invention, in particular, an alternate embodiment of the top latch 68' and the receiving lug 74'. In this embodiment the alternate top latch 68' has inwardly arranged catch knobs 69a, 69b. The receiving lug 74' is generally T-shaped with a downwardly extending stem 150' having a head portion 150a with a greater thickness than the remaining length of the stem 150'.

Figure 5:
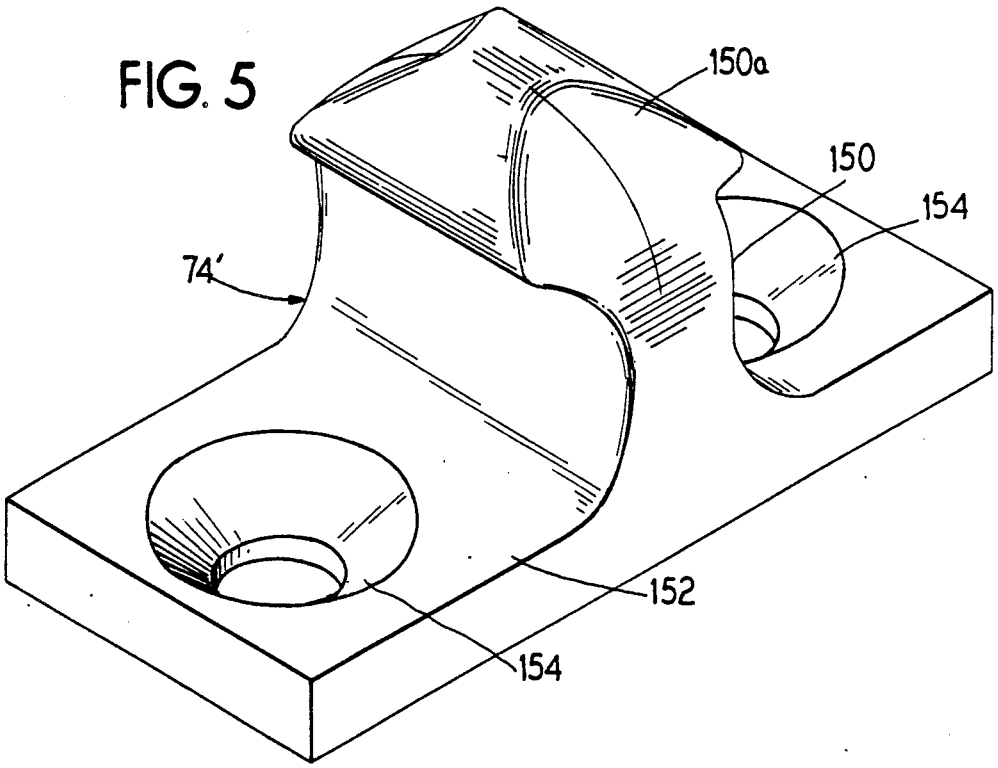
FIG. 5 is a perspective view of a frame lug shown in FIG. 4.

FIG. 5 shows more clearly the alternate receiving lug 74' with the head portion 150a of the stem 150'. The T-shape alternate receiving lug 74' is inverted for clarity. The alternate receiving lug 74' further comprises a base 152 for mounting to the upper frame member of the door frame. Two screw holes 154 are provided therethrough for mounting the alternate lug 74' to the upper frame member 75. The initially described receiving lug 74 can also be mounted to the upper frame member 75 using screws.

Viewing from left to right, FIGS. 6A through 6D show a progression from a latched to an unlatched condition. Viewing FIG. 6A to FIG. 6D it is recognized that the connector 116 is being drawn downwardly by the latching mechanicals 40, and the second reversing link 120 is pivoting about its second pivot pin 120a causing the third link 128 to rise. The rising of the third link 128 thereafter causes the pivoting of the latch cam 140 about the third pivot pin 140a.

Figures 6A, 6B, 6C, 6D, 7A, 7B, 7C:
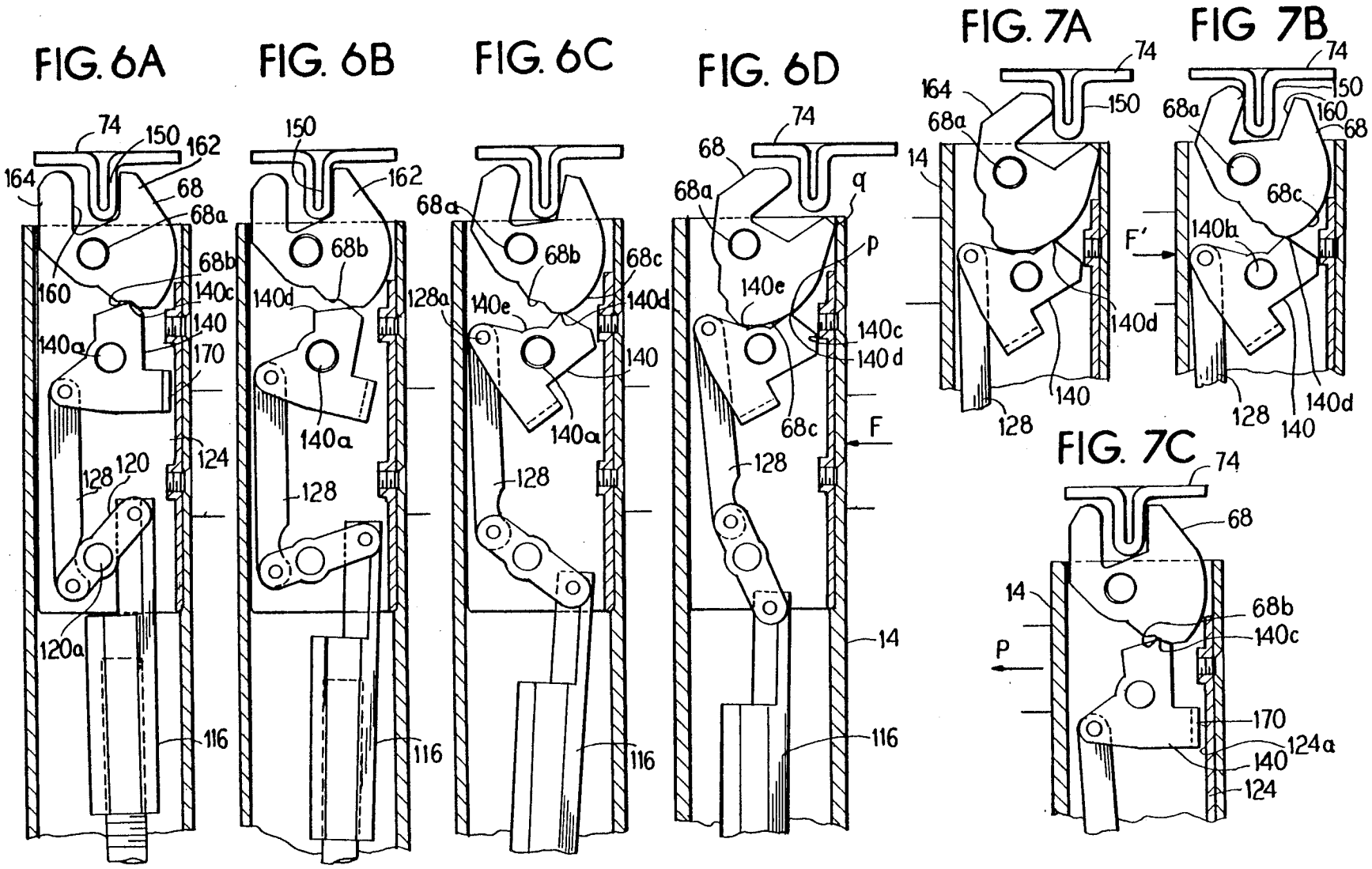
FIG. 6A is a partial sectional view taken generally along VI*a*—VI*a* of FIG. 3 with the door in a fully closed condition.
FIG. 6B –6D are partial sectional views of the door latch assembly of FIG. 6A showing a progression toward opening of the door with respect to a door frame holding the receiving lug with FIG. 6B showing a beginning to disengage condition and FIG. 6D showing a completely disengaged condition.
FIG. 7A is a partial sectional view of the latch assembly shown in FIG. 6D.
FIG. 7B–7C are partial sectional views of the latch assembly of FIG. 7A in a progression toward closing, FIG. 7B showing the assembly nearly engaged, and FIG. 7C showing the assembly completely engaged, as shown in FIG. 6A.

It is shown in FIG. 6A that the latch cam 140 comprises a first corner 140c which can reside in a notch 68b in the top latch 68. As FIG. 6A shows, the top latch 68 has formed therein a cavity 160 which captures the stem 150 of the receiving lug 74. The cavity 160 is formed by two legs, a trailing leg 162 and a leading leg 164. As the latch cam 140 pivots (clockwise in FIG. 6A to FIG. 6D) the first corner 140c passes out of the notch 68b and the trailing leg 162 presses against the stem 150 preventing counter clockwise rotation of the top latch 68 as shown in FIG. 6B. A second corner 140d of the latch cam 68 also passes the notch 68b as shown in FIG. 6C. Both of the corners 140c and 140d pass the notch 68b in sliding fashion.

On a trailing side of the top latch 68, the top latch 68 has fashioned thereon a rounded outside surface 68c. Also, the latch cam 140 is formed with a recess 140e located between the second corner 140d and the attachment pin 128a of the third link 128. As the latch cam 140 continues to rotate about the third pivot pin 140a', the rounded outside surface 68c slides past the second corner 140d and into the recess 140e. As shown in FIG. 6D, this allows the top latch 68 to now rotate in a clockwise fashion and disengage from the receiving lug 74. This rotation is enhanced by a pushing force F on the active door stile 14 caused by the pushing of a person exiting the door. This pushing force F causes the stationary receiving lug 74, particularly the stem 150, to press against the trailing leg 162 of the top latch 68 which in turn causes the clockwise pivoting of the top latch 68 about the fourth pivot pin 68a.

The latch cam 140 shown in FIG. 6D is held, while the top latch 68 is disengaged from the receiving lug 74, in a rotational orientation corresponding to the downward extension of the connector 116 as shown in FIG. 6D. Because the top latch 68 has rotated into clockwise position with the rounded outside surface 68c residing in the recess 140e, the second corner 140d abuts the rounded, outside surface 68c which prevents the counter clockwise rotation of the latch cam 140 despite being biased toward counter clockwise rotation (as shown in FIG. 6A-6D) by the first and second springs 82, 112. The second corner 140d abuts the rounded surface 68c at a point p which causes a reaction force on the top latch 68 which is either: aligned with the axis of the fourth pivot pin 68a to cause a zero moment on the top latch 68; or aligned exerting an offset force to the fourth pivot pin 68a to cause a clockwise moment on the top latch 68 which is resisted by a contact force at a point q between the trailing leg 162 and the latch frame 124. In either case the contact between the rounded surface 68c and the latch cam 140 is arranged to not cause a counter clockwise rotation of the top latch 68, and thus holds the latch cam 140 and the top latch 68 in the position shown in FIG. 6D for easy re-engagement with the lug 74.

Viewing FIGS. 7A through 7C in progression shows the closing of the active stile 14 to the door frame, particularly the re-engagement of the top latch 68 with the receiving lug 74. FIG. 7A shows the active stile 14 in initial contact with the door frame such that the leading leg 164 of the top latch 68 has made contact with the stem 150 of the receiving lug 174.

As the top latch 68 is moved into engagement with the receiving lug 74, the top latch 68 is forced to rotate in counter clockwise fashion about the fourth pivot pin 68*a*, as shown progressively in FIGS. 7A–7C. The leading leg 164 abutting the stem 150 creates this counter clockwise moment about the fourth pivot pin 68*a* . The rounded outside surface 68*c* slides over the second corner 140*d* . Once the second corner 140*d* clears the rounded outside surface 68*c* the top latch has captured the stem 150 inside the cavity 160 and the latch cam 140 can pivot in counter clockwise fashion about the third pivot pin 140*a*. Further counter clockwise rotation of the top latch 68 caused by a closing force F′ acting on the door and transferred to the leading leg 164 by the stem 150 allows the top latch 68 to rotate sufficiently for first corner 140*c* to slide into the notch 68*b*. The bias of the first spring 82 and the second spring 112 simultaneously causes the connector 116 to rise as shown in FIG. 6A, and the third link 128 drops as the latch cam pivots in counter clockwise fashion as shown in FIG. 7C. As shown in FIG. 7C the engagement of the top latch 68 with the receiving lug 74 is complete and the first corner 140*c* has engaged the notch 68*b*. Sufficient play exists between the stem 150 and the cavity 160 to permit over travel in the closing direction of the latch 68 to the lug 74.

FIG. 7C shows a rotation stop 170 formed on the latch cam 140 which can abut an inside surface 124*a* of the latch frame 124 to prevent counter clockwise rotation of the latch cam 140. Thus, a force P from outside the door stile 14 will be prevented from causing the top latch 68 to rotate clockwise, and to thereby disengage, because the top latch 68 cannot rotate clockwise unless the top latch could somehow counter roll the latch cam 140 in a counter clockwise direction; the notch 68*b* cannot slide over and escape the first corner 140*c*. Because the rotation stop 170 prevents such counter clockwise rotation of the latch cam, the door is secure.

Although the top assemblage comprising the top latch 68, the latch cam 140, the third link 128, the second reversing link 120, and the connector 116 have been described and depicted with respect so engaging a top of the door stile 14 to the top door frame 75, it as within the scope of the invention to invert this top assemblage for a bottom mounting to engage with a bottom frame member of the door frame, (replacing the bottom latch 62) alone or in conjunction with the top assemblage herein described, and such application is encompassed by the invention.

Although the present invention has been described with reference to a specific embodiment, those of skill in the art will recognize that changes may be made thereto without departing from the scope and spirit of the invention as set forth in the appended claims.

We claims as our invention:

1. A latch arrangement comprising:

a receiving lug mounted to the door frame and facing toward said door;

a latch rotatably mounted with respect to said door facing said lug, having a cavity arranged and adapted for capturing said receiving lug therein, said latch rotatable from a first position in a first rotational direction toward a second position to release said receiving lug from said cavity, and said latch rotatable from said second position to said first position in a second rotational direction to capture said receiving lug in said cavity;

a latch cam rotatably mounted with respect to said door on a side of said latch opposite said lug, said latch cam selectively and releasably rotatable to position an extending portion of said latch cam to abut an underside portion of said latch to prevent rotation of said latch in said first rotational direction from said first position, said latch cam having a recess adjacent to said extending portion, and said latch having a rounded surface adjacent to said underside portion, said latch cam releasable by rotation in said first rotational direction with said extending portion slidable past said underside portion and said rounded surface slidable into said recess when said latch rotates to said second position; and wherein said extending portion has a first corner and a second corner, said second corner adjacent to said recess, and said underside portion of said latch has a notch formed therein, said first corner adapted to interfit into said notch to prevent said latch from rotating from said first position in said first rotational direction; and said second corner slidable along said rounded surface during rotation of said latch to said second position.

2. A latch arrangement according to claim 1, wherein said receiving lug comprises a T-shape with a stem portion receivable by said cavity and a base portion anchorable to said door frame.

3. A latch arrangement according to claim 1, wherein said further comprising a link rotatably connected at a first end to said latch cam, offset from said axis of rotation of said latch cam; and a panic exit device mounted to said door, said link in chemical communication with said panic exit device.

4. A latch arrangement according to claim 3, wherein said further comprising a reverse link, and a push rod, said verse link rotatably connected at its middle with respect to said or and rotatably connected to a second end of said link at one d of said reverse link and rotatably connected to said push rod an opposite end of said reverse link, said push rod in chemical communication with said panic exit device.

5. A latch arrangement according to claim 4 further comprising a latch frame fixedly mounted to said door, said latch fame providing rotation connections for said reverse link, said latch, and said latch cam with respect to said door.

6. A latch arrangement according to claim 5, wherein said latch cam comprises a general T-shape, pinned at its middle to said latch frame, with said extending portion arranged on a stem of said T-shape, and a rotation stop arranged on one leg of said T-shape and said link connected onto another leg of said T-shape, with said recess formed between said extending portion and said link, said rotation stop facing an abutment wall of said latch frame when said latch is in said first position, preventing rotation of said latch cam in said second rotational direction.

7. A latch arrangement according to claim 6, wherein said cavity is formed with a generally rectangular trough formed into an outward facing surface of said latch, forming a leading leg and a trailing leg, and said lug comprises a stem portion extending from said door frame toward said cavity.

8. A latch arrangement according to claim 3, wherein said panic exit device provides a means for biasing said link in a direction causing a force on said latch cam urging said latch cam to rotate in said second rotational direction from an orientation corresponding to said second position of said latch; and said second corner is arranged to abut said rounded surface of said latch when said latch has rotated into said second position;

said rounded surface and said second corner are arranged and adapted to exert a moment on said latch which is greater than or equal to zero and only in said first rotational direction; and said latch is restrained by said door against further rotation in the first rotational direction past said second position.

9. A latch arrangement according to claim 3, wherein said cavity is formed with a generally rectangular trough formed into an outward facing surface of said latch, forming a leading leg and a trailing leg.

10. A latch arrangement according to claim 9, wherein said latch cam comprises a rotation stop which abuts portions of said door to prevent rotation of said latch cam in said second rotational direction with said latch in said first position.

11. A latch arrangement according to claim 8, wherein said latch cam comprises a general T-shape, pinned at its middle, with said extending portion arranged on a stem of said T-shape, said rotation stop arranged on one leg of said T-shape and said link connected onto another leg of said T-shape, with said recess formed between said extending portion and said link.

12. A latch arrangement according to claim 11, wherein said receiving lug comprises a T-shape with a stem portion receivable by said cavity and a base portion anchorable to said door frame.

13. A latch arrangement comprising:

a receiving lug mounted to the door frame and facing toward said door;

a latch rotatably mounted with respect to said door facing said lug, having a cavity arranged and adapted for capturing said receiving lug therein, said latch rotatable from a first position in a first rotational direction toward a second position to release said receiving lug from said cavity, and said latch rotatable from said second position to said first position in a second rotational direction to capture said receiving lug in said cavity;

a latch cam rotatably mounted with respect to said door on a side of said latch opposite said lug, said latch cam selectively rotatable to position an extending portion of said latch cam to abut an underside portion of said latch to prevent rotation of said latch in said first rotational direction from said first position, said latch cam having a recess adjacent to said extending portion, and said latch having a rounded surface adjacent to said underside portion, said latch cam rotatable in said first rotational direction with said extending portion slidable past said underside portion and said rounded surface slidable into said recess when said latch rotates to said second position;

wherein said extending portion has a first corner and a second corner, said second corner adjacent to said recess, and said underside portion to said latch has a notch formed therein, said first corner adapted to interfit into said notch to prevent said latch from rotating from said first position in said first rotational direction;

a link rotatably connected to a first end to said latch cam, offset from said axis of rotation of said latch cam;

a panic exit device mounted to said door, said link in mechanical communication with said panic exit device, wherein said panic exit device provides a means for biasing said link in a direction causing a force on said latch cam raging said latch cam to rotate in said second rotational direction from an orientation corresponding to said second position to said latch; and said second corner is arranged to abut said rounded surface of said latch when said latch has rotated into said second position;

said rounded surface and said second corner are arranged and adapted to exert a moment on said latch which is greater than or equal to zero and only n said first rotational direction; and said latch is restrained by said door against further rotation in the first rotational direction past said second position, wherein said latch cam comprises a general T-shape, pinned at its middle, with said extending portion arranged on a stem of said T-shape, said rotation stop arranged on one leg of said T-shape and said link connected onto another leg of said T-shape, with said recess formed between said extending portion and said link;

wherein said receiving lug comprises a T-shape with a stem portion having at its free end an enlarged head portion, receivable by said cavity, and a base portion anchorable to said door frame, and said leading leg and said trailing leg each have knob portions formed thereon at their free ends and inwardly facing.

14. A latch arrangement for use in selectively securing a door in a closed position relative to a door frame, comprising:

a first latch member mounted on said door frame;

a second latch member having a rounded surface on one side thereof and a notch formed at a termination of said rounded surface, said latch member pivotally mounted on said door and having a portion engageable with said first latch member in a first rotational position to secure said door closed relative to said door frame and disengageable from said first latch member in a second rotational position to permit opening of said door relative to said frame;

a cam member pivotally mounted on said door on a side of said second latch member opposite said first latch member, said cam member having an extending protrusion which is shaped to interfit into said notch formed in said second latch member and a recess formed adjacent said protrusion, said protrusion slidable along said rounded surface as said rounded surface interfits into said recess;

said protrusion applying a retaining force on said second latch member in both said first and second rotational positions to prevent said second latch member from rotating from either of said positions; and means for selectively overcoming said retaining force to permit said second latch member to move between said first and second rotational positions.

15. The latch arrangement according to claim 14, wherein said latch member is located on an upper portion of said door facing an upward member of said door frame and said receiving lug is mounted on said upper member of said door frame.

16. A latch arrangement for use in selectively securing a door in a closed position relative to a door frame, comprising:

a receiving lug having a T-shape with a stem portion having at its free end an enlarged head portion, and a base portion anchorable to said door frame;

a latch member pivotally mounted on said for and having an engaging portion engageable with said receiving lug when said latch member is in a first rotational position to secure said door closed relative to said door frame and disengageable from said receiving lug when in a second rotational position to permit opening of said door relative to said frame, said engaging portion providing a generally U-shaped configuration with a leading leg and a trailing leg, wherein said leading leg and a trailing leg, wherein said leading leg and said trailing leg each have knob portions formed thereon inwardly facing at their free ends;

means for applying a retaining force on said second latch member in both said first and second rotational positions to prevent said second latch member from rotating from either of said positions; and means for selectively overcoming said retaining force to permit said second latch member to move between said first and second rotational positions.

17. The latch arrangement according to claim 16, wherein said latch member is located on an upper portion of said door facing an upward member of said door frame and said receiving lug is mounted on said upper member of said door frame.

18. A latch arrangement for use in selectively securing a door in a closed position relative to a door frame, comprising:

a first latch member mounted on said door frame, said latch member providing a T-shape with a stem portion having at its free end an enlarged head portion, and a base portion anchorable to said door frame;

a second latch member, said second latch member having a general U-shape with a leading leg and a trailing leg, said leading leg and said trailing leg each having knob portions formed thereon at their free ends and inwardly facing, said second latch member having a rounded surface on one side thereof and a notch formed at a termination of said rounded surface, said second latch member pivotally mounted on said door and having a portion engageable with said first latch member in a first rotational position to secure said door closed relative to said door frame and diseagegeable from said first latch member in a second rotational position to permit opening of said door relative to said frame;

a cam member pivotally mounted on said door on a side of said second latch member opposite said first latch member, said cam member having an extending protrusion which is shaped to interfit into said notch formed in said second latch member and a recess formed adjacent said protrusion, said protrusion slidable along said rounded surface as said rounded surface interfits into said recess;

said protrusion applying a retaining force on said second latch member in both said first and second rotational positions to prevent said second latch member from rotating from either of said positions; and means for selectively overcoming said retaining force to permit said second latch member to move between said first and second rotational positions.

19. The latch arrangement according to claim 18, wherein said latch member is located on an upper portion of said door facing an upward member of said door frame and said receiving lug is mounted on said upper member of said door frame.

20. The latch arrangement according to claim 1, wherein said latch member is located on an upper portion of said door facing an upward member of said door frame and said receiving lug is mounted on said upper member of said door frame.

21. A latch arrangement according to claim 1, wherein said receiving lug comprises a T-shape with a stem portion having at its free end an enlarged head portion, receivable by said cavity, and a base portion anchorable to said door frame, and said cavity formed having a leading leg and a trailing leg arranged in a U-shaped fashion, said leading leg and said trailing leg each having knob portions formed thereon at their free ends facing inwardly toward each other.

* * * * *